US008568081B2

(12) United States Patent
Song et al.

(10) Patent No.: US 8,568,081 B2
(45) Date of Patent: Oct. 29, 2013

(54) AXIAL THRUST BALANCED IMPELLER FOR USE WITH A DOWNHOLE ELECTRICAL SUBMERSIBLE PUMP

(75) Inventors: Baojun Song, Tulsa, OK (US); David Chilcoat, Jenks, OK (US)

(73) Assignee: Baker Hughes Incorporated, Houston, TX (US)

( * ) Notice: Subject to any disclaimer, the term of this patent is extended or adjusted under 35 U.S.C. 154(b) by 805 days.

(21) Appl. No.: 12/763,905

(22) Filed: Apr. 20, 2010

(65) Prior Publication Data

US 2011/0255951 A1 Oct. 20, 2011

(51) Int. Cl.
*F04D 27/00* (2006.01)

(52) U.S. Cl.
USPC ..... 415/1; 415/104; 415/106; 415/113; 415/199.1; 416/1; 416/198 R; 416/198 A

(58) Field of Classification Search
USPC ..... 415/1, 104, 106, 113, 199.1; 416/1, 416/198 R, 198 A
See application file for complete search history.

(56) References Cited

U.S. PATENT DOCUMENTS

| | | | | |
|---|---|---|---|---|
| 3,975,117 | A | 8/1976 | Carter | |
| 4,838,758 | A | 6/1989 | Sheth | |
| 4,867,633 | A | 9/1989 | Gravelle | |
| 5,722,812 | A * | 3/1998 | Knox et al. | 415/199.1 |
| 6,068,444 | A * | 5/2000 | Sheth | 415/199.2 |
| 6,106,224 | A | 8/2000 | Sheth et al. | |
| 6,309,174 | B1 | 10/2001 | Okeljas | |
| 6,805,529 | B2 | 10/2004 | Liu | |
| 7,575,413 | B2 | 8/2009 | Semple | |
| 7,648,332 | B2 | 1/2010 | Eslinger | |
| 2004/0096320 | A1 | 5/2004 | Yevtushenko | |
| 2010/0040492 | A1 | 2/2010 | Eslinger et al. | |

FOREIGN PATENT DOCUMENTS

| | | |
|---|---|---|
| GB | 790009 | 1/1958 |

OTHER PUBLICATIONS

International Search Report and Written Opinion of the International Searching Authority, Oct. 25, 2011, 9 pages.

* cited by examiner

*Primary Examiner* — Igor Kershteyn
(74) *Attorney, Agent, or Firm* — Bracewell & Giuliani LLP

(57) ABSTRACT

An electrical submersible pumping system having a pump, a motor, a shaft connecting the pump and motor. Coaxially stacked rotating impellers and stationary diffusers are coaxially housed within the pump. Radial ports are formed in a hub of the diffusers that direct fluid pressurized by an impeller to a cavity formed on the shroud of the impeller. Axial ports are formed in the shrouds of the impellers that direct fluid from the cavity to a fluid flow passage within the impeller. Strategic placement and sizing of the radial and axial ports balances thrust forces exerted onto the impeller.

18 Claims, 4 Drawing Sheets

AXIAL THRUST BALANCED IMPELLER FOR USE WITH A DOWNHOLE ELECTRICAL SUBMERSIBLE PUMP

BACKGROUND

1. Field of Invention

The present disclosure relates in general to submersible well pumps, and in particular to impellers and diffusers having strategically positioned ports that automatically direct fluid adjacent impellers and diffusers to axially balance the impellers.

2. Background of the Invention

In oil wells and other similar applications in which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations. One such conventional pumping system is a submersible pumping assembly which is immersed in the fluids in the wellbore. The submersible pumping assembly includes a pump and a motor to drive the pump to pressurize and pass the fluid through production tubing to a surface location. A typical electric submersible pump assembly ("ESP") includes a submersible pump, an electric motor and a seal section interdisposed between the pump and the motor.

Centrifugal well pumps are commonly used as the submersible pump in an ESP application to pump oil and water from oil wells. Centrifugal pumps typically have a large number of stages, each stage having a stationary diffuser and a rotating impeller driven by a shaft. The rotating impellers exert a downward thrust as the fluid moves upward. Also, particularly at startup and when the fluid flow is non-uniform, the impellers may exert upward thrust. It is most common for the impellers to float freely on the shaft so that each impeller transfers downward thrust to an adjacently located diffuser. Thrust washers or bearings are often located between each impeller and the upstream diffuser to accommodate the axially directed upward and/or downward thrusts.

Hardware components in the pump to accommodate the thrusts are especially susceptible to wear when subjected to abrasive materials as well as corrosive fluids. Example abrasives include sand that may be produced along with the oil, formation particles, and fractured production hardware. Corrosive fluids, such as those containing $H_2S$, may corrode pump components and form a coarse irregular contact surface. The abrasive material causes wear of the pump components, particularly in the areas where downward thrust and upward thrust are transferred.

SUMMARY OF INVENTION

Disclosed herein is a method of producing fluid from a subterranean formation. In an example embodiment, a method is described that includes providing a submersible pump that has a rotatable shaft, and an impeller on the shaft. A fluid flow passage is in the impeller that can register with a passage in a stationary diffuser downstream of the impeller. The method can further involve flowing fluid into the fluid flow passage in the impeller along with rotating the impeller to pressurize the fluid. The pressurized fluid is discharged from the impeller into the fluid flow passage in the diffuser. Reactive forces that axially act on the impeller to force it upwards can be countered by a downward force created from the pressurized fluid. In an example embodiment, the downward force is created by directing a portion of the pressurized fluid from the fluid flow passage in the diffuser to a cavity between an upstream side of the diffuser and a downstream side of the impeller. In one example, the impeller is balanced with the downward force so that it is out of contact with the diffuser. The pressurized fluid from the fluid flow passage in the diffuser can be directed through a diffuser port formed through a portion of the diffuser to the cavity. Alternatively, fluid from the cavity can be directed through an impeller portion extending from the cavity to the fluid flow passage in the impeller. The fluid from the cavity through the impeller port can be regulated to the passage in the impeller. In an example embodiment, the fluid can be regulated by blocking fluid communication between the cavity and the impeller port when the thrust force on the impeller urges the impeller downstream against the diffuser. The diffuser can have an annular thrust washer that sealingly engages the impeller port when the impeller is moved downstream into contact with the diffuser. An embodiment of the present method exists where the impeller is forced away from the diffuser. In yet another embodiment, fluid can be directed down an annular clearance between the hub of the diffuser and the hub of the impeller to a diffuser port in the hub that leads to an upper side of the impeller.

Also described herein is an example embodiment of a centrifugal pump that includes a stationary diffuser, a rotatable shaft, an impeller mounted on the shaft, and a radial port through a portion of the diffuser. In one example, the radial port provides a flow path for fluid pressurized by the impeller to a cavity. The cavity may be disposed so that it is on a downstream side of the impeller and an upstream side of the diffuser. In an example embodiment, the centrifugal pump also includes an annular inner clearance between the diffuser bore and impeller hub where a diffuser port allows flow from the annular inner clearance to the cavity. An annular outer clearance may also be included that is set between a sidewall of the diffuser and a shroud on the impeller; the annular outer clearance can direct fluid from an outlet of the impeller to the cavity. The centrifugal pump can also be equipped with an impeller port from the impeller passage to the cavity through which fluid in the cavity flows into the impeller passage. The pump may optionally include a thrust washer on the diffuser. The thrust washer contacts the cavity when the impeller contacts the diffuser and blocks flow from the cavity to an impeller passage. Embodiments exist where the diffuser port is radial and the impeller port is axial An example embodiment of an alternative centrifugal pump is described herein that is made up of a stationary diffuser, a rotatable shaft, an impeller mounted on the shaft, and a radial port through a portion of the diffuser that defines a flow path between fluid pressurized by the impeller to an external surface of the impeller. An axial port can be formed through a portion of the impeller for allowing flow between the external, surface of the impeller and a flow passage in the impeller. An annular thrust washer can be provided on the diffuser that faces the axial port. The thrust washer can be aligned with the port so that when the impeller is pushed upward, the thrust washer contacts the axial port to block flow through the port. The radial and axial ports may be strategically sized to allow an amount of fluid flow therethrough to axially space the impeller out of contact with the diffuser. A cavity may optionally be included with the centrifugal pump that is formed on the external surface of the impeller that registers with the radial port. Fluid flow passages can be formed in the diffuser and impeller that are registerable to define a production fluid flow path. In an example embodiment, a return bypass flow path extends from the fluid flow passage in the diffuser, between an annular hub of the impeller and an inner circumference of the impeller, and to the radial port. Yet further optionally, a plurality of radial ports can be formed in the diffuser hub. The diffuser, in one example embodiment, may be a downstream diffuser. Moreover, an upstream diffuser can be included that has a fluid flow passage that selectively registers with an inlet of a fluid, flow passage in the impeller.

BRIEF DESCRIPTION OF DRAWINGS

Some of the features and benefits of the present invention having been stated, others will become apparent as the description proceeds when taken in conjunction with the accompanying drawings, in which.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION OF THE EXEMPLARY EMBODIMENTS

The present invention will now be described, more fully hereinafter with reference to the accompanying drawings in which exemplary embodiments of the invention are shown. This invention may, however, be embodied in many different forms and should not be construed as limited to the illustrated embodiments set forth herein; rather, these embodiments are provided so that this disclosure will be through, and complete, and will fully convey the scope of the invention to those skilled in the art. Like numbers refer to like elements throughout.

Figure 1:
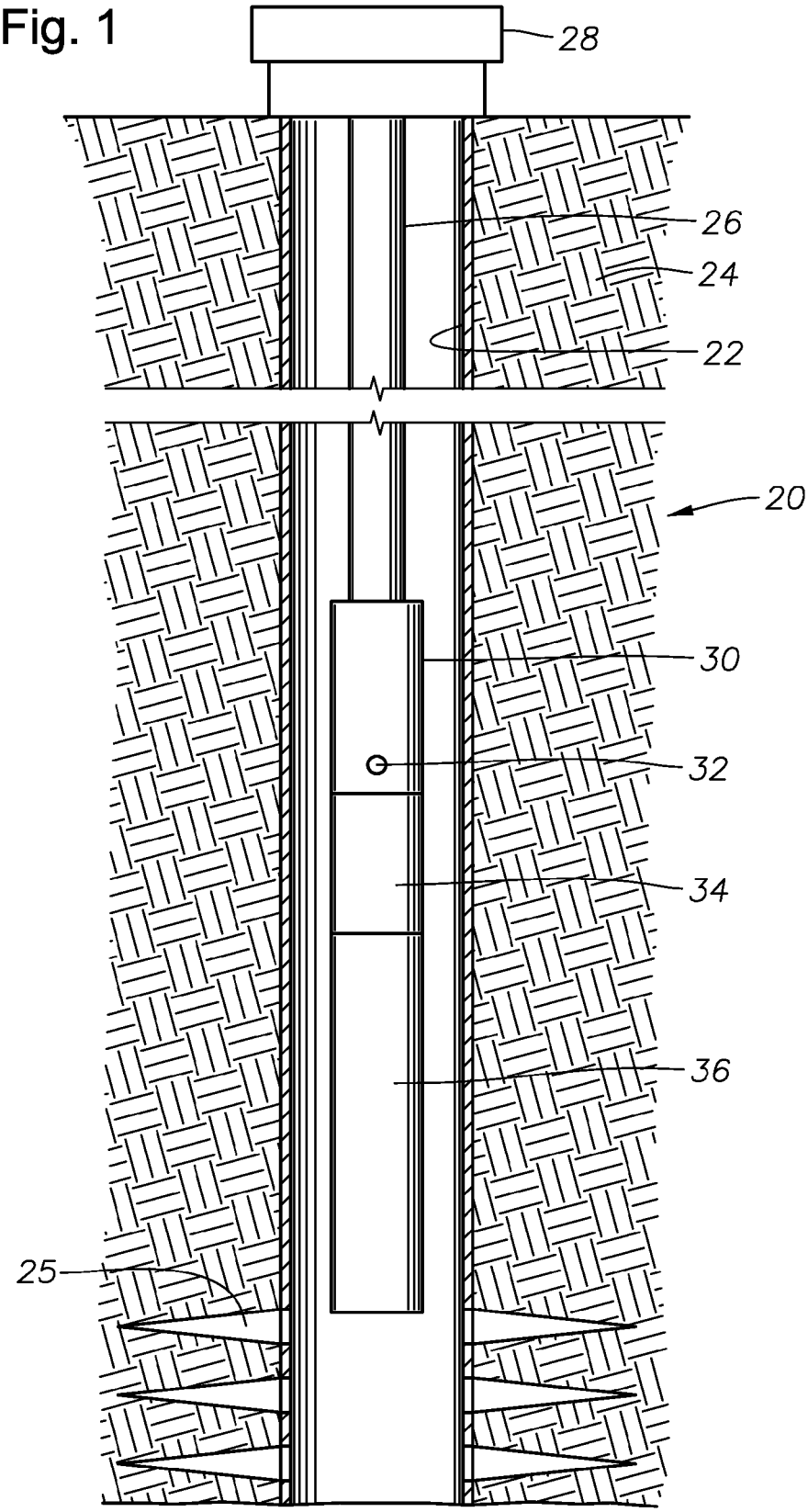
FIG. 1 is a side partial sectional view of an example embodiment of an electrical submersible pumping (ESP) system disposed in a wellbore.

Referring now to FIG. 1, shown in a side partial sectional view is an example embodiment of an electrical submersible pumping (ESP) system 20 disposed within a wellbore 22. The wellbore 22 intersects a subterranean formation 24; connate fluid flows into the wellbore 22 from perforations 25 illustrated projecting, into the formation 24. The ESP 20 pressurizes the connate fluid that is then directed through production tubing 26 shown attached on an upper end of the ESP 20. The fluid flows from the production tithing 26 into an attached wellhead assembly 28 for distribution and processing. A pump 30 is included with the ESP 20 shown coupled on the lower end of the tubing 26. The connate fluid enters the pump 30 via a fluid inlet 32 (shown provided on a side of the pump 30) where the fluid is pressurized prior to delivery through the tubing 26. An optional separator (not shown) may be included upstream of the pump for moving, or separating gas phase fluid from liquid. Attached on a lower end of the pump 30 is a seal section or equalizer 34 for pressure equalization between the pressure in the wellbore 22 and a motor 36 shown on a lower end of the seal 34. A shaft (not shown) couples between the motor 36 and the pump 30 for driving the pump 30.

Figure 2:
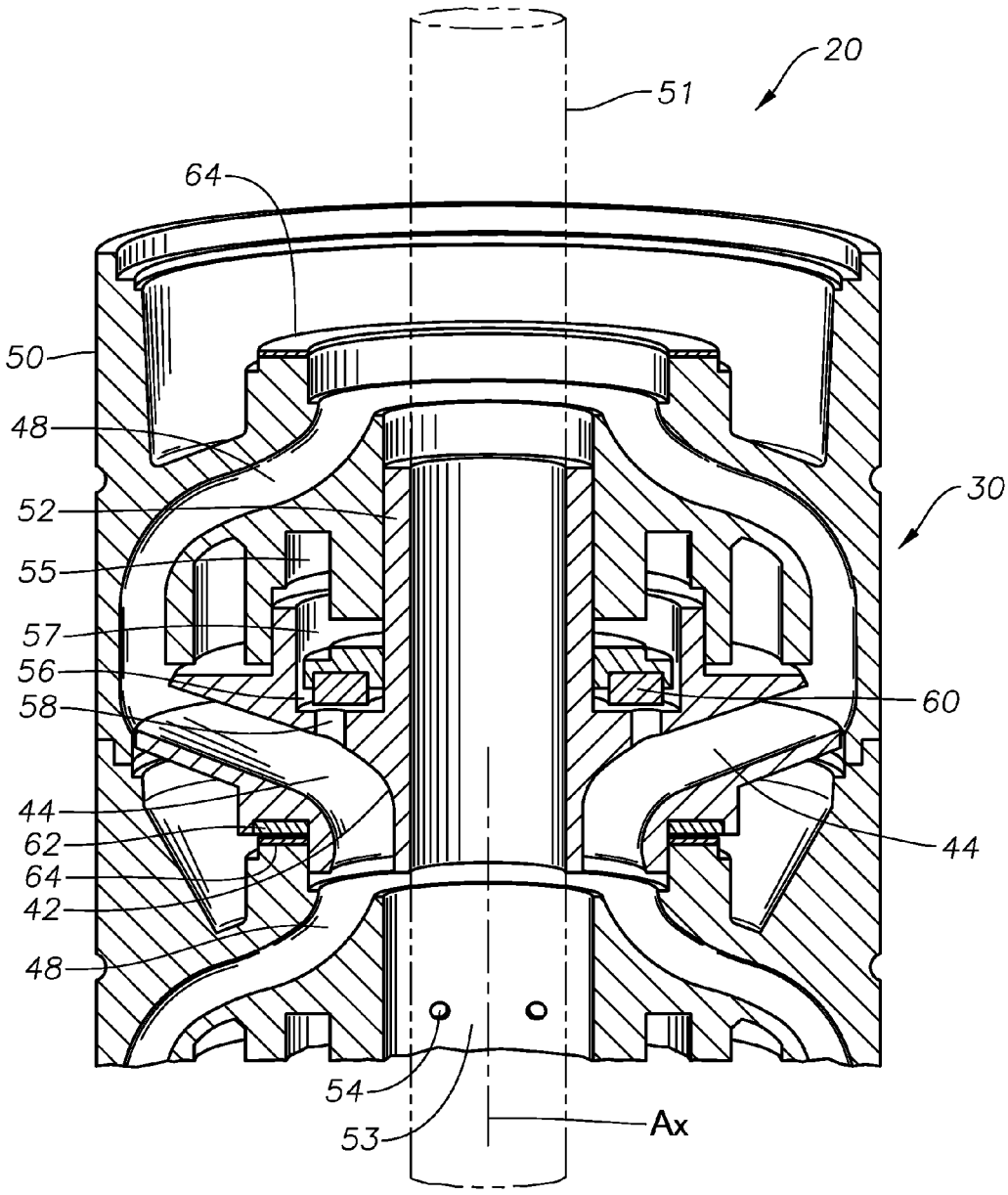
FIG. 2 is a side perspective sectional view of an example embodiment of a submersible pump.

The pump 30, which may be a centrifugal pump, is shown in a side sectional perspective view in FIG. 2 which reveals an annular impeller 42 coaxially disposed along an axis $A_X$ of the pump 30. The impeller 42 includes a body that extends radially outward from the axis $A_X$. Fluid passages 44 are shown formed in the body of the impeller 42. As is known, providing fluid to the pump 30 while rotating the impeller 42 about the axis $A_X$ directs a fluid flow within the fluid passages 44. Impeller 42 rotation pressurizes the fluid within the passages 44 and also in corresponding passages 48 shown provided in adjoining diffusers 50 also coaxially set within the motor 36. Although a single impeller 42 is shown, embodiments exist having coaxially stacked impellers 42 intermixed with coaxially stacked diffusers 50. A combination of the series of stacked impellers 42 and diffusers 50, along with their respective curved flow passages 44, 48 define a serpentine fluid flow path that winds along the axial length of the pump 30 in which fluid may be progressively pressurized.

The impeller 42 is shown coaxially mounted onto an elongated shaft 51. The impeller 42 includes a hub 52 that projects upward from the body of the impeller 42 and axially along the outer circumference of the shaft 51. The diffuser 50 includes a diffuser hub 53 shown circumscribing a portion of the impeller hub 52. Shown formed through the diffuser hub 53 are radial ports 54 that provide fluid communication between the inner circumference of the diffuser hub 53 and a cavity 55 formed in the diffuser 50 between the flow passage 48 and the diffuser hub 53. The cavity 55 is therefore in fluid communication with an interface shown between impeller hub 52 and the diffuser hub 53. A corresponding cavity 57 is formed on an outer surface of the impeller 50 and facing the cavity 55.

In the embodiment of FIG. 2 the impeller 42 is shown in what is referred to herein as an equalized or floating position so that the impeller 42 is axially spaced apart from the diffuser 50. When in the equalized position, a space 56 forms between a lower facing surface of the diffuser 50 and an upwardly facing surface of the impeller 42.

In an example of operation of the pump 30, as the impeller 42 rotates about the axis $A_X$ and fluid flows through the passages 44, 48 fluid "downstream" will increase in pressure. In the example of FIG. 2, the diffuser 50 circumscribing the impeller hub 54 is referred to as a downstream diffuser whereas the diffuser 50 on the opposite or lower side of the impeller 42 is referred to as an upstream diffuser.

Figure 3A:
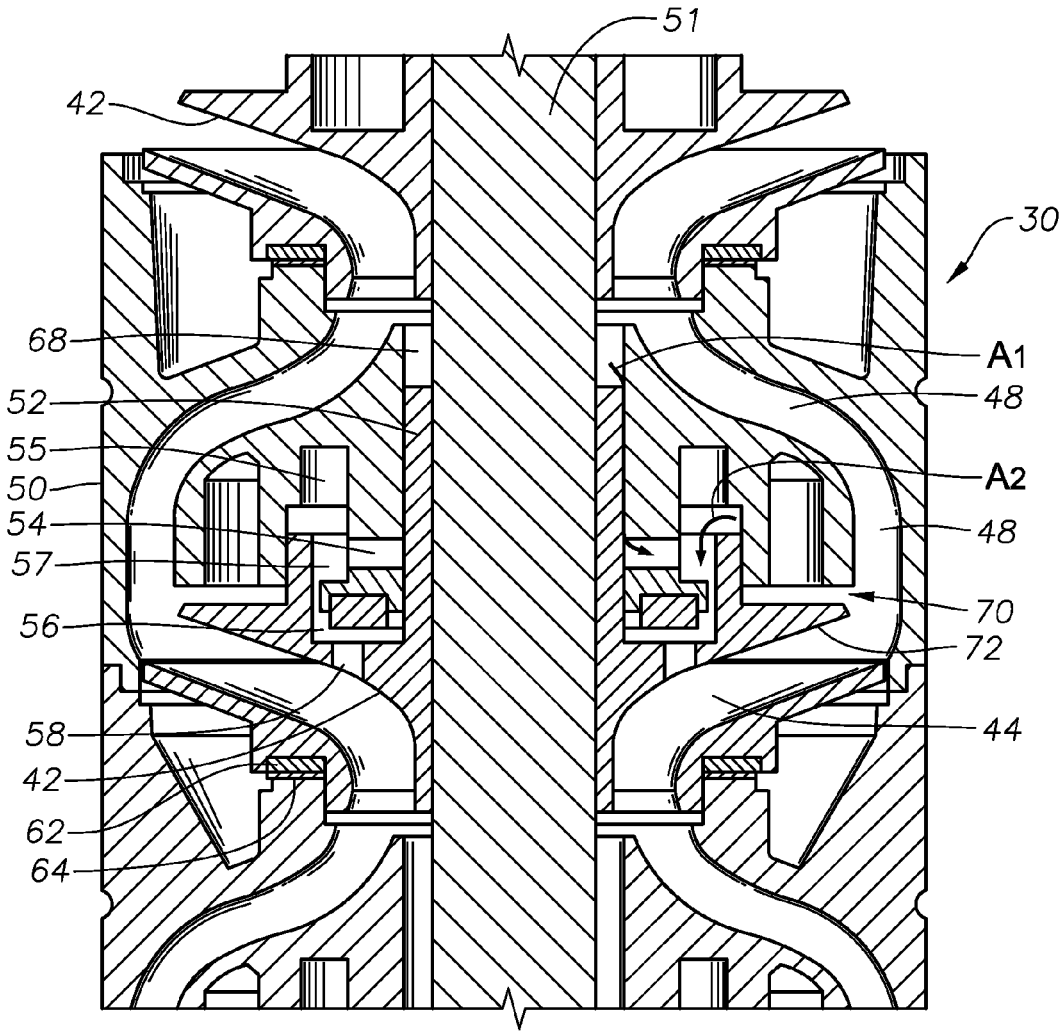
FIG. 3A is a side sectional view of an example embodiment of the pump of FIG. 2 in a bypass return flow open position.

Referring now to FIG. 3A, the impeller 42 is shown placed in a fully open position, as will be described in more detail below. As can be seen in FIG. 3A as flow path, defined by arrow $A_1$, is created by the higher pressure fluid within the diffuser passage 48 making its way between the diffuser hub 53 and impeller hub 52 and into the radial port 54. Once in the port 54, the fluid is directed into the cavities 55, 57. In the open position of FIG. 3A, cavities 55, 57 are in fluid communication with the impeller flow path 44 through an axial port 58 formed through the impeller 42 from its upper outer surface to the flow passage 44. Referring back now to FIG. 2, a thrust washer 60 is shown provided on the lower facing surface of the downstream diffuser 50 and in alignment with the axial port 58. Also illustrated are thrust washers 62, 64 disposed respectively on the lower surface of the impeller 42 and upper surface of the upstream diffuser 50. The thrust washer 62, 64 of FIG. 2 are annular members that coaxially align when the impeller 42 moves downward. Downward movement of the impeller 42 may result from reactive thrusts when the impeller 42 rotates to pressurize fluid.

Still referring to FIG. 3A, when in the open position a clearance 70 is present between the lower facing surface of the diffuser 50 and an outer radial upwardly facing surface of an impeller shroud 72. The clearance 70 provides an additional flow path, as illustrated by arrow $A_2$, for fluid pressurized by the impeller 42 to then flow into the cavities 55, 57 and exert a downward force onto the impeller 42.

Figure 3B:
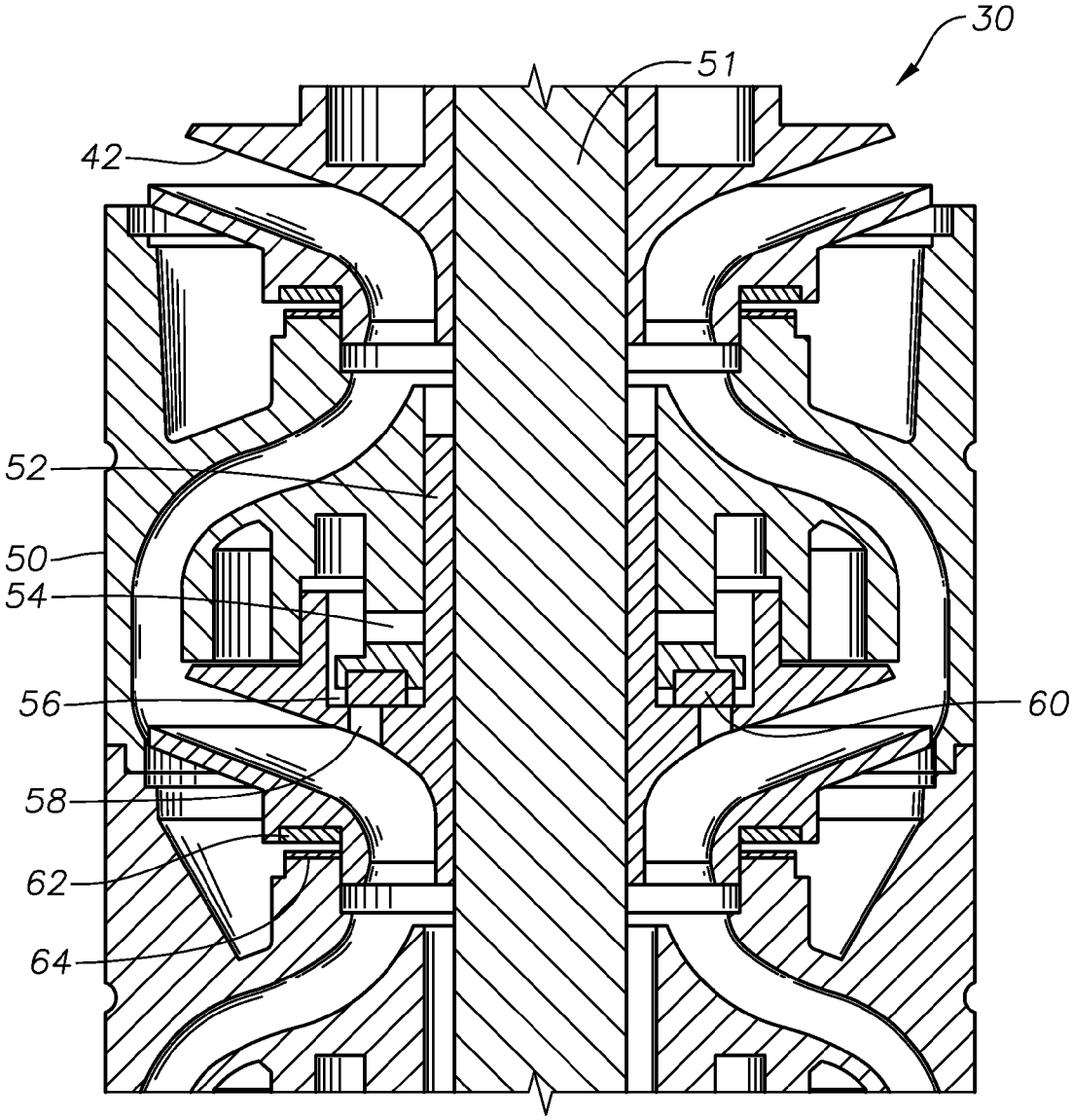
FIG. 3B is an example embodiment of the pump of FIG. 2 in a bypass return flow closed condition.

FIG. 3B depicts an impeller dosed position that can reflect a situation when the impeller 42 is thrust vertically upward, such as during pump start up or when encountering low density fluid. When in an impeller closed position, the thrust washer 60 contacts the bottom of the cavity 57 and seals against the axial port 58. The thrust washer 60 has an annular configuration, so that irrespective of the angular position of the axial port 58 as the impeller 42 rotates, when urged downward against the impeller 42, the thrust washer 60 can seal against the axial port 58. While in this configuration, operational fluid dynamics of the rotating impeller 42 forcing fluid through the flow passages 44, 48 pressurizes the cavities 55, 57. With increasing pressure in the cavities 55, 57, an increasing pressure differential forms axially across the impeller 42 producing a downwardly directed resultant force on the impeller 42. Thus when in the closed position of FIG. 3B, an upward thrust on the impeller 42 is countered by a growing force applied to the upper surface of the impeller 42. Ultimately, the growing downward force exceeds the upward thrust to urge the impeller 42 downward towards the upstream diffuser 50.

By strategically sizing the radial ports 54 and axial port 58, balancing forces may be produced to maintain the impeller 42 in the equalized or "floating" position such as that shown in FIG. 2. In the embodiment of FIG. 2 the impeller 42 is spaced apart from both the upstream and downstream diffusers 50 in response to the applied balancing forces acting on the impeller 42.

It is understood that variations may be made in the above without departing from the scope of the invention. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. A method of producing fluid from a subterranean formation, comprising:

(a) providing a submersible pump that comprises: a rotatable shaft, an impeller mounted on the shaft, a fluid flow passage through the impeller, a stationary diffuser downstream of the impeller, and a fluid flow passage through the diffuser;

(b) flowing fluid into the fluid flow passage in the impeller and rotating the impeller to pressurize the fluid;

(c) discharging the pressurized fluid from the impeller into the fluid flow passage in the diffuser; and (d) forcing the impeller in an axial direction by directing a portion of the pressurized fluid from the fluid flow passage in the diffuser through a port in the diffuser and to a cavity between an upstream side of the diffuser and a downstream side of the impeller.

2. The method of claim 1, wherein step (d) comprises balancing the impeller so that it is out of contact with the diffuser.

3. The method of claim 1, further comprising directing fluid from the cavity through an impeller portion extending from the cavity to the fluid flow passage in the impeller.

4. The method of claim 3, further comprising countering a thrust force exerted on the impeller by regulating fluid communication from the cavity through the impeller port to the passage in the impeller.

5. The method of claim 4, wherein regulating fluid communication comprises blocking fluid communication between the cavity and the impeller port and when the thrust force on the impeller urges the impeller downstream against the diffuser.

6. The method of claim 5, wherein the diffuser further comprises an annular thrust washer that sealingly engages the impeller port when the impeller is moved downstream into contact with the diffuser.

7. The method of claim 1, wherein step (d) comprises forcing the impeller away from the diffuser.

8. The method of claim 1, further comprising directing fluid down an annular clearance between the hub of the diffuser and the hub of the impeller to a diffuser port in the hub that leads to an upper side of the impeller.

9. A centrifugal pump, comprising:

a stationary diffuser;

a rotatable shaft;

an impeller mounted on the shaft;

a radial port through a portion of the diffuser that defines a flow path for fluid pressurized by the impeller to a cavity on a downstream side of the impeller and an upstream side of the diffuser;

an annular inner clearance between the diffuser bore and impeller hub;

a diffuser port from the annular inner clearance to the cavity;

an annular outer clearance between a sidewall of the diffuser and a shroud on the impeller to direct fluid from an outlet of the impeller to the cavity; and an impeller port from the impeller passage to the cavity through which fluid in the cavity flows into the impeller passage.

10. The pump of claim 9, further comprising a thrust washer on the diffuser that blocks flow from the cavity to an impeller passage when the impeller contacts the diffuser.

11. The pump of claim 9, wherein the diffuser port is radial.

12. The pump of claim 9, wherein the impeller port is axial.

13. A centrifugal pump, comprising:

a stationary diffuser having a diffuser passage;

a rotatable shaft;

an impeller mounted on the shaft for rotation therewith and having an impeller passage that delivers fluid to the diffuser passage;

a cavity defined between a downstream side of the impeller and an upstream side of the diffuser; and a diffuser port in fluid communication with the diffuser passage and leading to the cavity to apply force to the downstream side of the impeller.

14. The centrifugal pump of claim 13, further comprising an impeller port formed through a portion of the impeller from the impeller passage to the cavity.

15. The centrifugal pump of claim 14, further comprising an annular thrust washer on a surface of the diffuser facing the impeller port, and aligned with the impeller port so that when the impeller is thrust in a downstream direction, the thrust washer sealingly contacts the impeller port.

16. The centrifugal pump of claim 14, wherein the diffuser port and the impeller port are strategically sized so that when the impeller is rotating fluid flow through the diffuser port into the cavity exerts an axial force onto the impeller that axially spaces the impeller out of contact with the diffuser.

17. The centrifugal pump of claim 13, further comprising: an impeller hub extending into a diffuser bore, and an annular inner clearance between the impeller hub and the diffuser bore for receiving a portion of the fluid flowing out of the diffuser passage, where the diffuser port extends from the inner annular clearance to the cavity.

18. The centrifugal pump of claim 13, further comprising a skirt on the impeller that extends into engagement with an inward facing side wall of the diffuser, an annular outer clearance between the skirt and the side wall that allows a portion of the fluid being pressurized by the impeller to flow through the outer clearance into the cavity.

* * * * *